United States Patent [19]

Evans

[11] 4,083,193

[45] Apr. 11, 1978

[54] OFFSHORE APPARATUS AND METHOD FOR INSTALLING

[75] Inventor: James E. Evans, Houston, Tex.

[73] Assignee: Marathon Oil Company, Findlay, Ohio

[21] Appl. No.: 751,837

[22] Filed: Dec. 17, 1976

[51] Int. Cl.[2] ..... E02B 17/00

[52] U.S. Cl. ..... 61/96; 61/50

[58] Field of Search ..... 61/87, 88, 89, 90, 92, 61/94, 96, 97, 98, 99, 50

[56] References Cited

U.S. PATENT DOCUMENTS

| | | | |
|---|---|---|---|
| 2,979,911 | 4/1961 | Sutton | 61/96 X |
| 3,191,388 | 6/1965 | Ludwig | 61/88 |
| 3,355,899 | 12/1967 | Koonce et al. | 61/95 X |

FOREIGN PATENT DOCUMENTS

| | | | |
|---|---|---|---|
| 1,104,352 | 2/1968 | United Kingdom | 61/92 |

*Primary Examiner*—Jacob Shapiro

*Attorney, Agent, or Firm*—Joseph C. Herring; Jack L. Hummel

[57] ABSTRACT

The offshore apparatus in preferred form comprises a structure mounted on the ocean floor and terminating in a platform located beneath the surface of the water to carry loads extending above the surface. A plurality of legs extend generally vertically through a template base resting on the ocean floor and are anchored in the ocean bed below the base. A load platform is connected to the upper portions of the legs and is buoyant enough to maintain the legs in tension and to support the load which it carries. A stabilizer member is connected to the legs intermediate their length and is also buoyant to apply additional tension to the legs, and a series of mooring members are connected to the stabilizer member to minimize side sway in response to ocean currents. In the preferred method of installation, all three components are buoyant and are towed to the site of operations as a unit, and lowered to the ocean floor by ballasting them with sea water. The legs are installed through passages in the components and the platform and stabilizer member are de-ballasted to rise to their final positions while the base remains ballasted and serves to maintain the integrity of the anchoring of the legs.

38 Claims, 12 Drawing Figures

OFFSHORE APPARATUS AND METHOD FOR INSTALLING

BACKGROUND OF THE INVENTION

The apparatus and method of this invention lie in the field of offshore operations of various kinds and are directed primarily to the drilling and maintenance of wells located beneath the ocean floor. They are more particularly directed to the provision of apparatus suitable for supporting drilling or servicing equipment used in connection with wells which are located at great water depths.

Since the inception of exploration for oil beneath the ocean floor a great variety of drilling rigs have been devised and built for use in varied situations. In the earlier part of the period drilling was usually confined to fairly shallow water and it was possible to sink shafts or pilings into the ocean bed, anchor them, and then mount a working structure which extended above the surface of the water. The working platform was located above the crests of the waves to minimize disturbance. Since the jackets (or towers) and platforms were very heavy the shafts or legs were in compression and had to be very large and strong to prevent column failure; thus, the structures were quite expensive. Moreover the shafts were continually subjected to wave action which caused considerable beam bending. The platforms were permanently attached and were subject to all of the storms which occurred, and added wind load to wave load applied to the shafts. As drilling moved to deeper water, the legs or shafts became longer and both compressive and bending forces became more servere. The use of this system in depths beyond a few hundred feet becomes extremely difficult and costly.

Submersible type rigs have also been used for many years. In this type, a complete structure is built up initially, including a hollow base section which may be filled with air so that the rig can be floated to the site of operations where the base is ballasted with sea water and sinks to the ocean floor. Once it is placed in position it is virtually the same as the built-up structure previously mentioned and is subject to all of the same problems.

Another type which has been used extensively is the floating rig. This includes ships or barges which are located over the drill site and which require massive mooring systems to combat the forces of winds and waves which continually tend to move them out of position. They may use mooring cables or propellers operating in different directions, or both. Since the rigs are practically never stationary they require very complicated and expensive drilling apparatus. Another type of floating rig employs very large floats or pontoons which remain beneath the surface and structural members rising above the surface to support working platforms. They are thus somewhat less responsive to wind and wave forces. While the floating rigs can obviously be used in deep water, far beyond the range of the other types, they still suffer the disadvantage of being constantly in motion and requiring expensive drilling apparati.

SUMMARY OF THE INVENTION

The apparatus and method of the present invention overcome the difficulties mentioned above and provide a system which is relatively easy to install, at much lower cost, and which can be used successfully in water depths greater than present compression and/or gravity structures are being used.

Generally stated, the apparatus in its presently preferred form includes a template base, a plurality of anchoring legs, and a stabilizer member and load platform connected to the legs. The base rests on the ocean floor and the legs extend vertically down through a plurality of laterally spaced vertically extending passages in the base and are anchored in the ocean floor below the base. The legs extend upward toward the surface in a predetermined pattern and their lower ends cannot move out of their original position because of their engagement with the passages in the base.

The stabilizer member and the load platform each have a plurality of vertically extending passages which are in vertical registry with those of the base, and the legs extend upward through corresponding passages with a sliding fit. The stabilizer member is fixedly connected to the legs at a location intermediate their vertical length and locks them together. In addition, mooring members are connected to the stabilizer member, extend outward and downward, and are anchored in the ocean floor to further minimize lateral movement.

The load platform is fixedly connected to the upper portions of the legs and similarly locks them into a unit. The buoyancy of both the platform and the stabilizer members are controllable and act to maintain the entire length of the legs in tension. Thus there is no compression column loading in the legs, and the bending forces are minimal. The platform in mounted position is located at a point well below the surface of the water so that wind and wave motion have no tendency to displace it. Although it is subject to ocean currents, their effect is not sufficient to cause any significant displacement.

The operation of installing the present apparatus is simpler and easier than that required in setting up compressive and gravity types which have a multiplicity of columns or shafts individually secured to the ocean bed and require structural building work at the site. In the preferred mode, each of the components is formed as a hollow compartment, the passages being defined by sleeves extending between the upper and lower surfaces and secured thereto in an airtight manner, as by welding. All components have the same planform and they are stacked as a unit at the shore, with the passages in registry, and locked together. The components are initially full of air and they are floatingly towed to the site of operations, where they are ballasted with sea water and lowered to the ocean floor under control of a derrick barge.

Drilling or jetting mechanisms are lowered through some or all of the sets of passages to drill holes in the ocean bed below the base. Legs are then lowered in vertical attitude through the passages and anchored, e.g. cemented, in place. The components are then unlocked from each other and the platform and the stabilizer member are de-ballasted to a desired degree and floated upward with the legs in sliding relation with the passages. The one or more stabilizer members are stopped at a location intermediate the vertical length of the legs and fixedly connected to them. The platform is further de-ballasted and permitted to rise to the upper portions of the legs where it is rigidly secured to them.

Mooring members are secured to the stabilizer and anchored to the ocean bed to minimize any side sway of the column. Both the platform and the stabilizer are partially de-ballasted to produce the desired buoyancy and maintain the legs in tension, preventing compression column loading on the legs. The platform is of such size that its maximum buoyancy is in excess of any predetermined load which it will be required to carry. Preferably the legs are of heavy walled tubular steel and may also be de-ballasted to render additional buoyancy.

At least one well conductor may initially be passed through a set of passages and anchored in the same manner as the legs. When this is done, the stabilizer member and the platform will be anchored to the well conductor in the same way and it will also be held in tension. The components may be formed with additional registering passages to be used in drilling additional wells if desired. The base is left with the water ballast therein to keep it securely on the ocean floor so that it continuously serves to maintain the integrity of the anchorage of the legs and well conductor.

If desired, the base may be ballasted with concrete, barite, sand or other heavy material at the site of operations, or it may be a solid mass of metal or reinforced concrete or like material. The base may be made of structural members in the form of a template or guide having little or no positive buoyancy. Also, the components may be transported separately and arranged in stacked relation in the course of lowering them into position. However, it is considered that the operation described in detail above is preferable.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
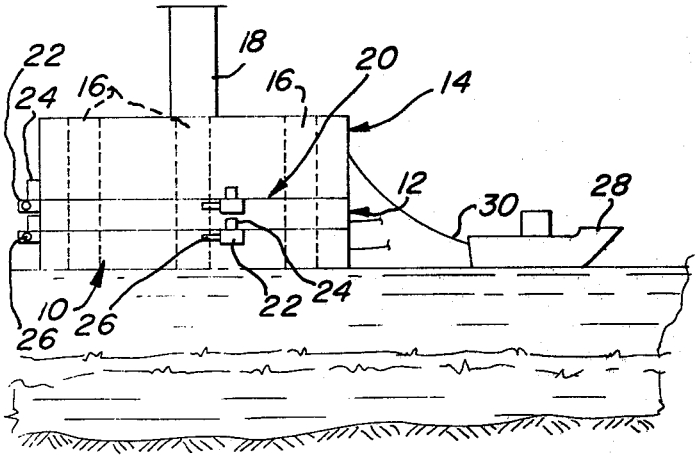
FIG. 1 is a schematic elevational view of the three stacked components of the invention afloat and being towed to the site of operations.

The arrangement for transporting the buoyant components to the site of operations is schematically illustrated in FIG. 1, in which the template base 10, the stabilizer member 12, and the load platform 14 are shown stacked upon one another. Each of the components is formed as a hollow shell or compartment of substantial lateral expanse and is provided with a plurality of laterally spaced vertically extending passages 16 therethrough arranged in the same pattern in each component, the platform 14 having a conductor housing 18 substantially aligned with one of the passages connected to the upper side of the platform and extending upward.

The components are arranged with their passages in vertical registry and are held in assembled relation for transport by locks 20. Each lock includes a lug 22 having an upwardly opening socket and secured to the upper portion of the side wall of one component, a lug 24 secured to the lower portion of the side wall of the next higher component and having a depending apertured tongue to fit in the socket, and a lock unit 26 secured to the side of lug 22 actuatable to force a locking pin into the apertured tongue of a lug 24. Thus the components are secured against vertical separation and also against relative lateral displacement so that the passages will remain in registry until the locks are released.

Figure 2:
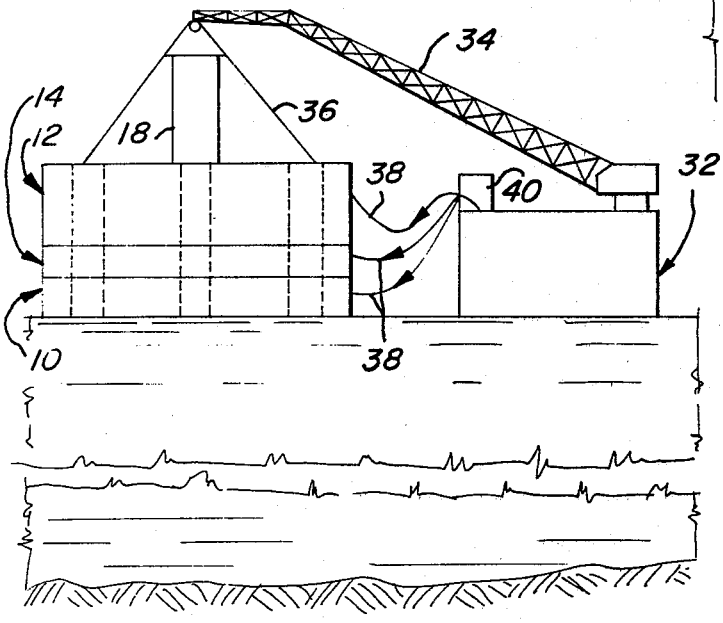
FIG. 2 is a similar view showing the components on location and about to be submerged.

The components are filled with air to a greater or lesser extent to provide adequate buoyancy and stability and a tug 28 is attached to the stacked unit by a cable 30 to tow it to the site of operations. When the unit arrives at the site a derrick barge 32 is brought into position as indicated in FIG. 2. The derrick 34 is attached to the unit by cables 36 and flexible conductors 38 are strung from each component to the control console and supply unit 40 on the deck of the barge. Each conductor 38 contains the necessary conduits for supplying air, water, and hydraulic fluid to each of the components and for withdrawing the fluids as necessary.

It is to be understood that fluids other than air and water may be employed to control the relative bouyancy of the components throughout the operation of the invention. Air and water are obviously most expedient under many conditions of operation and therefore for convenience of discussion, they are the examples employed. The selection of alternative fluids is deemed within the capabilities of those skilled in art depending on the requirements of a specific operation.

Figure 4:
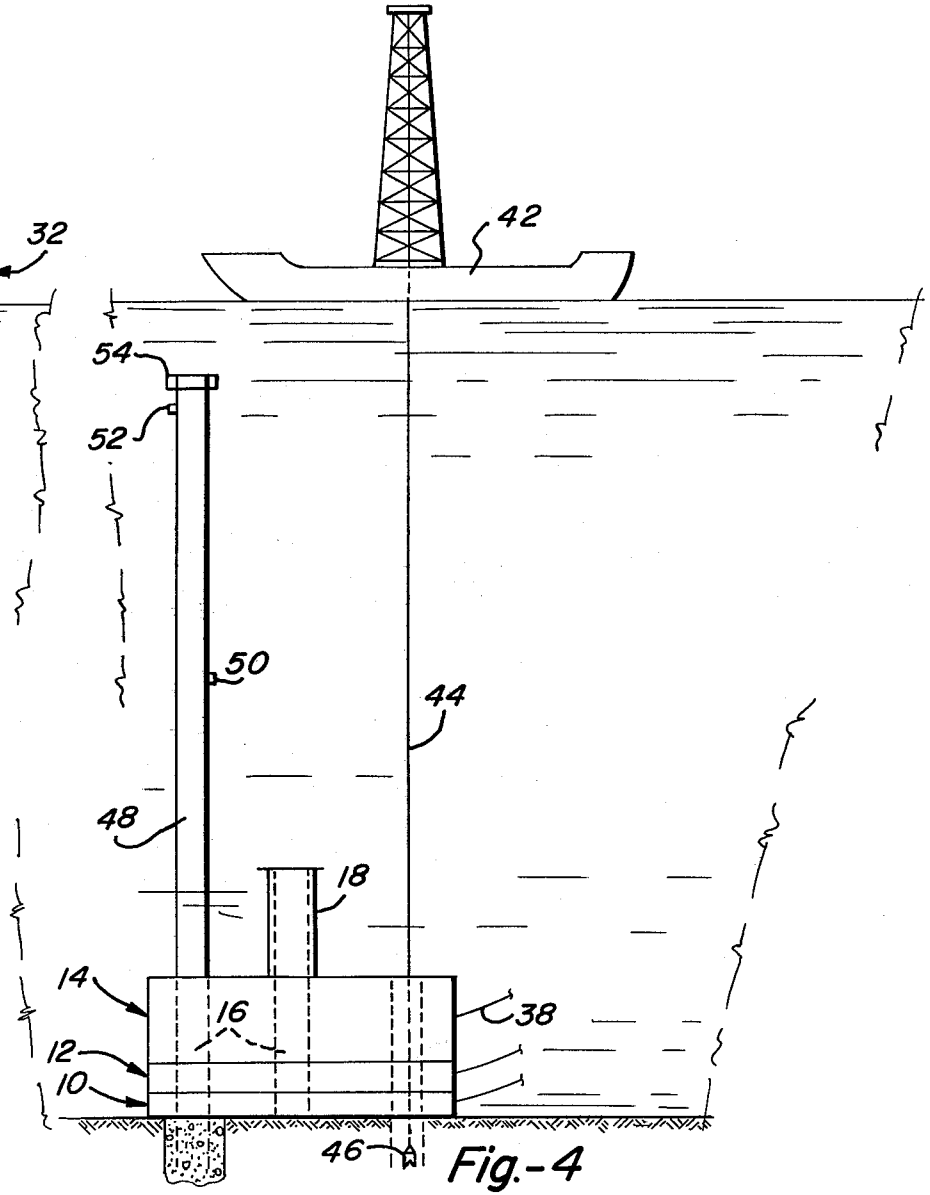
FIG. 4 is a similar view showing a first leg anchored in place and a drilling or jetting apparatus forming a second hole.
Figure 3:
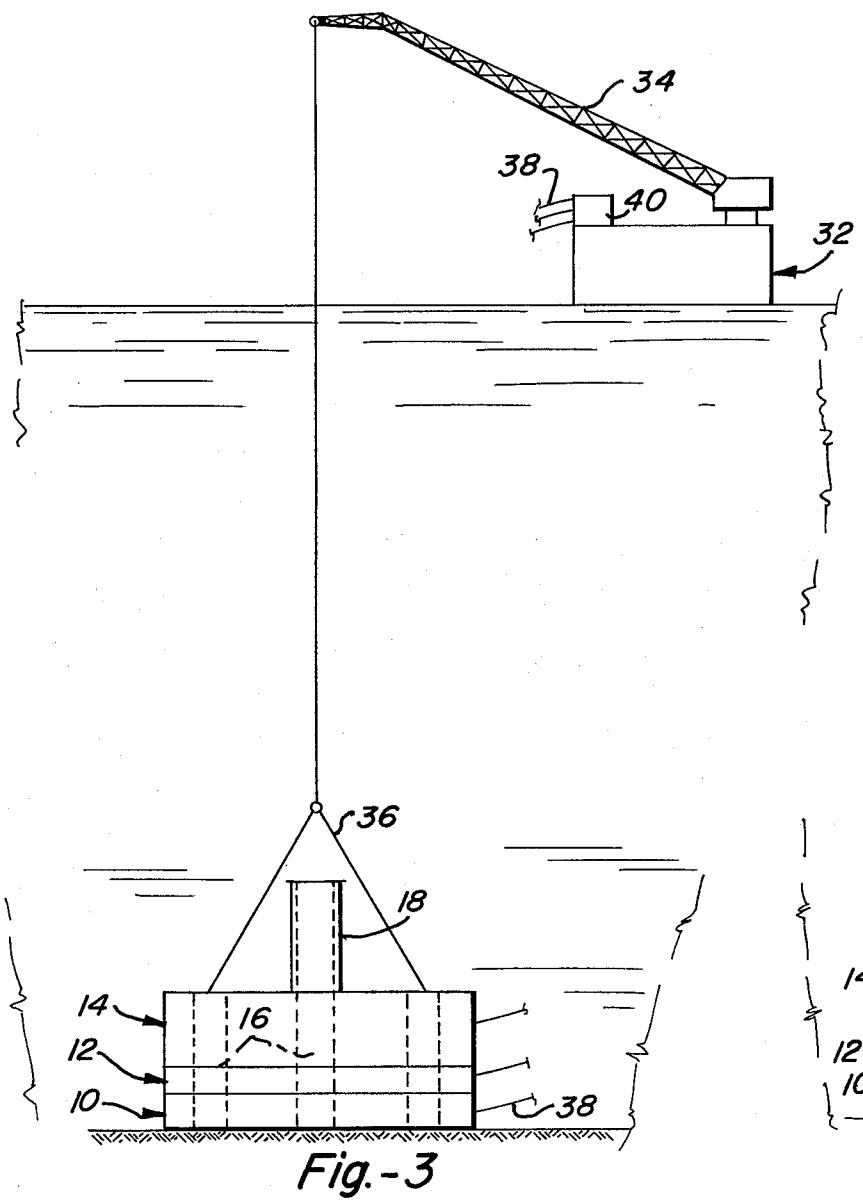
FIG. 3 is a similar view showing the components lowered to the ocean floor.
Figures 5, 6, 7:
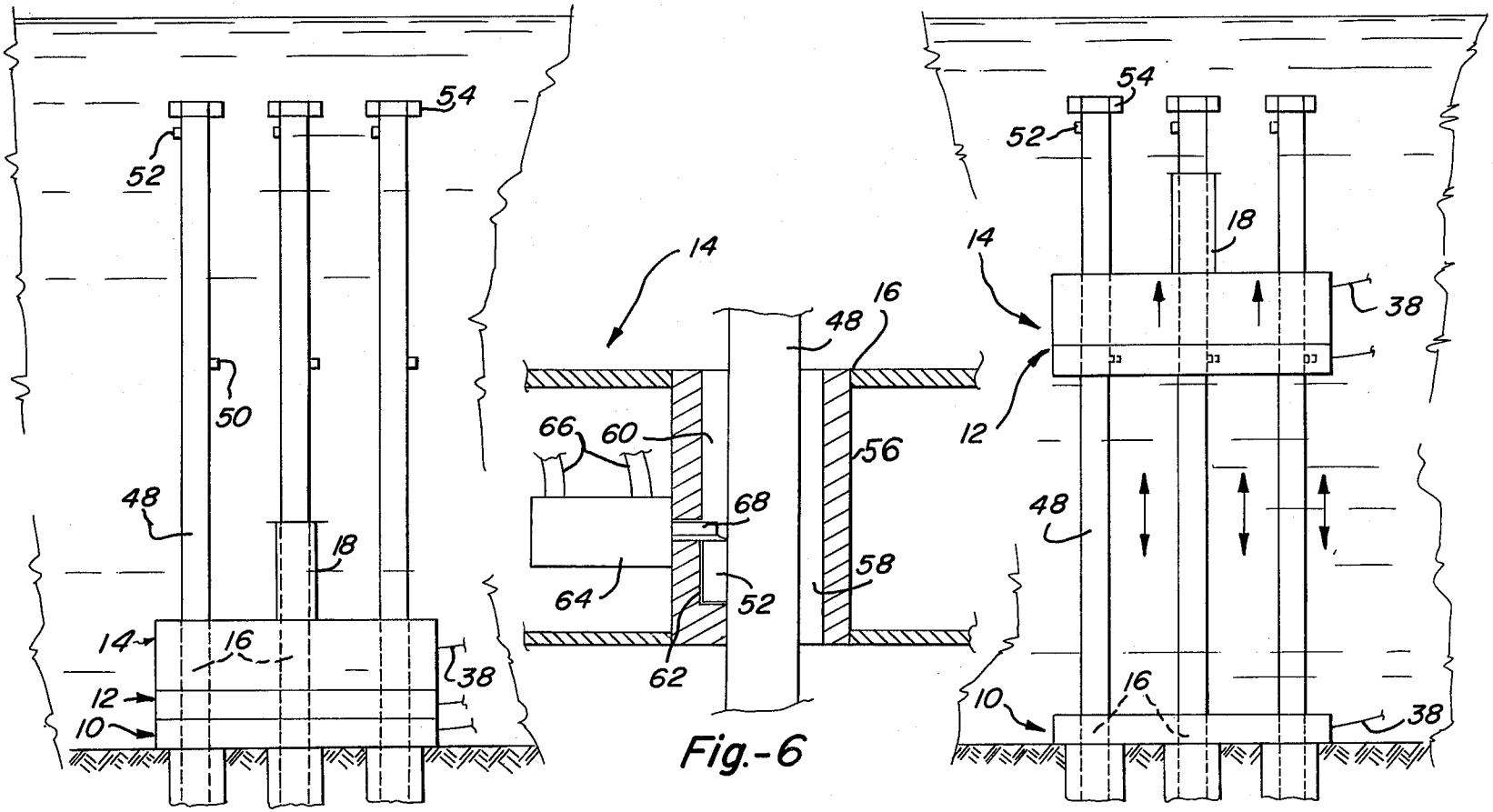
FIG. 5 is a similar view showing all units in place and ready for the erection operation.
FIG. 6 is a sectional view of the platform taken through one of the passages, showing one exemplary form of locking mechanism.
FIG. 7 is a view similar to FIG. 5, showing the platform and stabilizer member raised to intermediate position with the stabilizer member locked in place.

When the stacked unit is accurately spotted, water ballast is added to the components in sufficient quantity to make the stack negative buoyant and it is lowered to the ocean floor under the control of the derrick as illustrated in FIG. 3. The derrick barge moves away and a drill vessel 42 is brought in as shown in FIG. 4, where one anchorage leg has been set and a second anchorage hole is being drilled or jetted. A drill string 44 is lowered form the vessel and the bit or jet bend 46 passes through a set of passages 16 and into the ocean bed to produce a hole of suitable size as indicated in the right hand portion of FIG. 4. The drill string and bit are then removed from the hole and passages and an elongate rigid anchorage leg 48 is lowered in vertical attitude and inserted in the set of passages and into the drilled hole and cemented in place as indicated in the left hand portion of FIG. 4. The leg may be a solid steel member but preferably is formed of tubular pipe such as well casing of suitable diameter and wall thickness. It will be noted that it is provided at a location intermediate its length with a locking lug 50 and at an upper portion with a second locking lug 52 extending outward in the opposite direction. A buoyancy cell 54 is detachably connected to the upper end of the leg to assist in supporting it in an upright position. It will be noted that the template base and the other two components provide elongate drill guides in the form of the passages 16 which accurately locate each drill hole with respect to the others, and that base 10 further serves continuously to keep the legs in proper relation and maintain the integrity of the anchorage. When all of the legs have been anchored in position the structure is as shown in FIG. 5 with all of the legs extending vertically in parallelism and accurately spaced in predetermined pattern. In practice the central leg is a well conductor bay to be used for the actual drilling of several wells. In large structures there may well be several well conductors arranged in selected sets of passages.

While various types of locking means may be used for securing the stabilizer member and the load platform in their final positions, one exemplary form is shown in FIG. 6 solely for purposes of illustration. In this figure, one of the passages 16 in platform 14 is shown as comprising a thick walled sleeve 56 welded to the upper and lower walls of platform 14 in air tight manner. A first complete channel 58 is dimensioned to freely pass by locking lug 50 as the platform rises. A second channel 60 at the opposite side of the sleeve is dimensioned to freely receive locking lug 52 but the lower end of the channel is closed to present abutment 62 to engage the lower side of lug 52 when the platform has reached its final position. A hydraulic servo motor 64 is provided with lines 66 leading to the hydraulic lines in conductors 38 and is actuatable to move locking pin 68 into channel 60 immediately above lug 50 and fixedly secure the platform to the leg. A similar arrangement is provided in each passage in the platform. The stabilizer member is provided with the same locking arrangement but the sleeves in the stabilizer member do not require complete channels similar to the channel 58.

The next stage in the process is shown in FIG. 7. The stabilizer member 12 has been de-ballasted to render it buoyant, after releasing all of the locks 20, and sufficient air has been inserted in platform 14 to render it slightly negative buoyant and keep it in contact with the stabilizer member. When the two components have risen to the position shown, the servo motors 64 in the stabilizer member are actuated to move the locking pins 68, and the stabilizer member is fixedly secured to the anchorage legs and the well conductor.

The buoyancy cells 54 are now released from the upper ends of the legs and the well conductor, and additional air is inserted in the platform to cause it to rise up and engage the locking lugs 52, and the servo motors in the platform are then actuated to fixedly secure the platform to the upper portions of the legs. While the legs and well conductor may rise to any desired level above the platform for any desired useful purpose, it is presently preferred to have them terminate substantially at the upper side of the platform as indicated.

Figure 8:
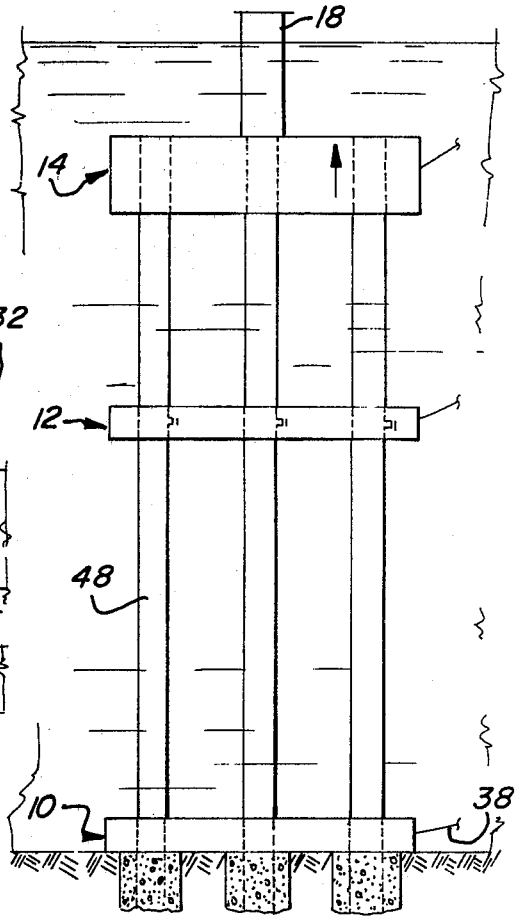
FIG. 8 is a similar view showing the platform raised to the upper portions of the legs and locked in place.
Figure 9:
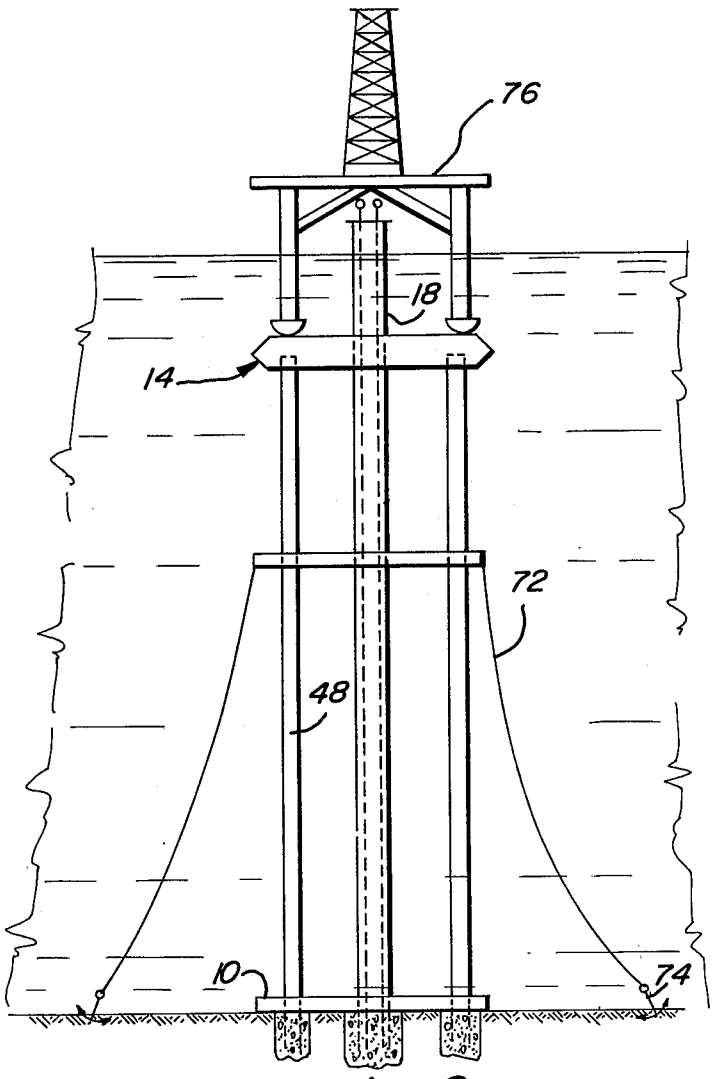
FIG. 9 is a similar view showing semisubmersible drilling rig lowered to rest on the platform.

It will be apparent that with the stabilizer member and load platform firmly secured in position as shown in FIG. 8 and with the base engaging the lower ends of the legs the entire structure constitutes a column of considerable lateral expanse and rigidity so that side sway is minimized. In addition, as seen in FIG. 9, mooring members are provided, with their first ends 72 connected to the stabilizer member and extending outward and downward, their second ends 74 being anchored in the ocean bed to further minimize any lateral movement of the legs. While typical anchors are shown it is to be understood that anchorage holes may be drilled at great distances from the structure and ends 74 connected to tie-down fittings cemented in the holes.

The buoyancy in the stabilizer member and platform are controlled to provide desired buoyancy, and they continually apply tension at all times to the entire length of the legs so that the legs are not subjected to compression column loading and hence will not buckle, irrespective of their length. If desired, when the lengths are very great, more than one stabilizer may be used to provide added stiffness. In shallower waters, where the structure of the invention is equally desirable, the legs may be short enough so that the one stabilizer member may be dispensed with.

If base 10 is a hollow compartment, as in the preferred form, it is preferably left entirely full of water to produce maximum net weight and enhance its utility in maintaining the integrity of the anchorage.

Platform 14 in its mounted position is located well below the surface of the water. The location depends on wave height and is chosen to be below the level at which wave motion harmonics produce destabilizing forces. Although the structure is still subject to ocean currents, their forces are normally insufficient to produce any significant effects.

Figure 10:
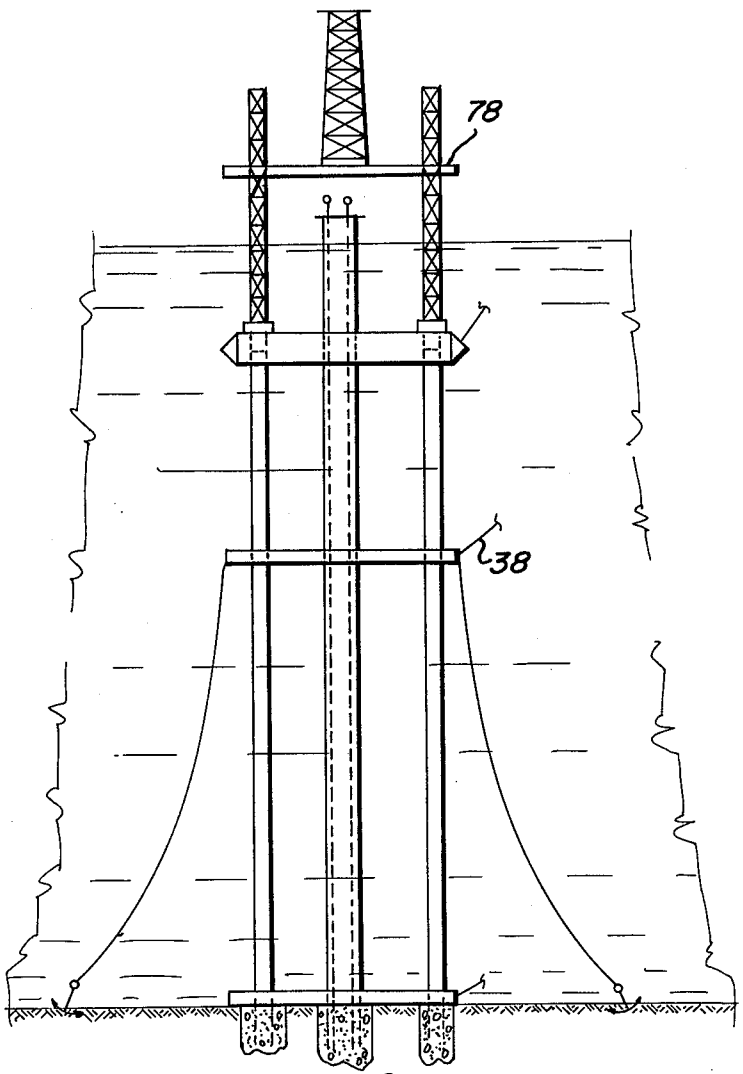
FIG. 10 is a similar view showing a jack-up type rig mounted on the platform.
Figure 12:
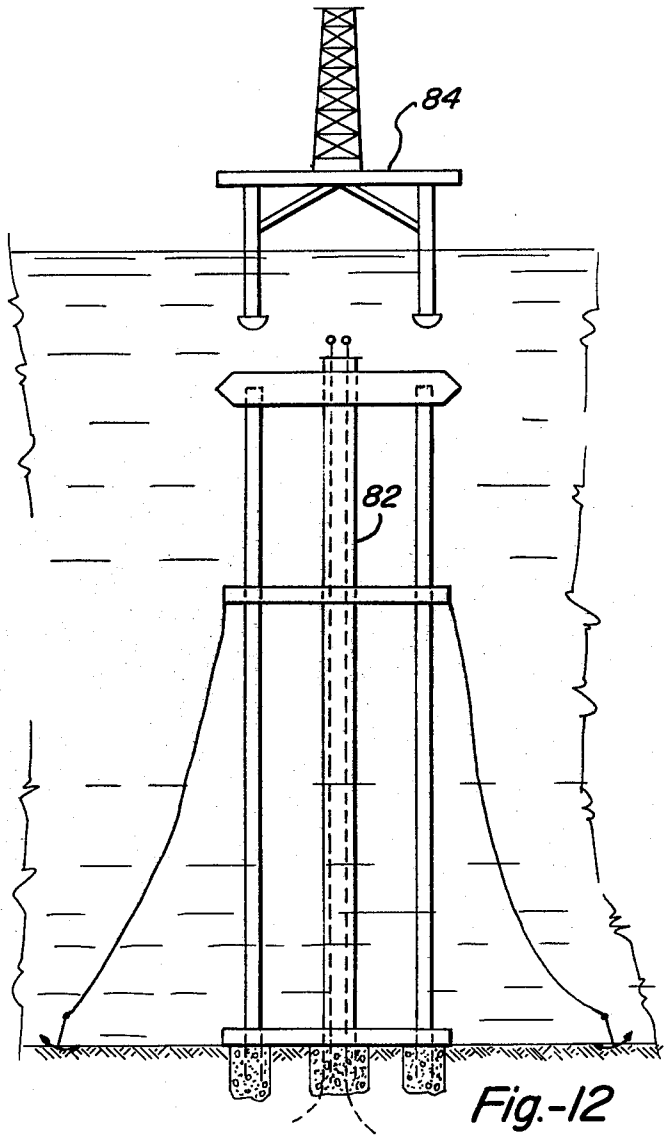
FIG. 12 is a similar view showing a semisubmersible rig servicing submerged wells.
Figure 11:
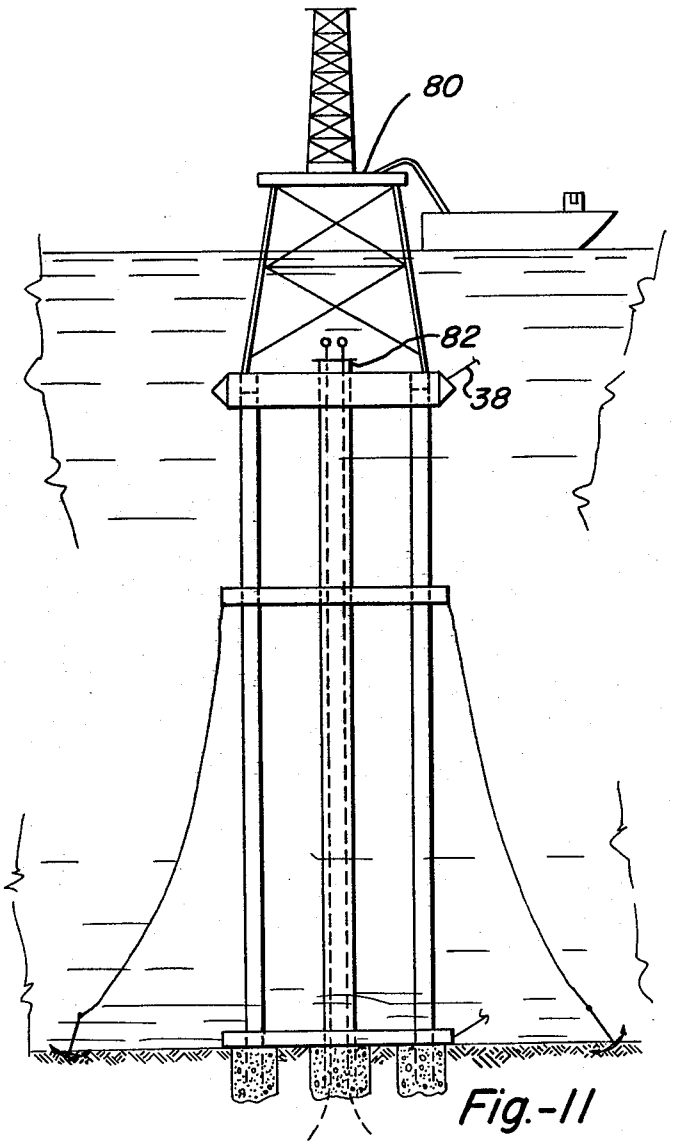
FIG. 11 is a similar view showing a temporary structure mounted on the platform.

The platform is of such magnitude that it not only applies tension to the legs but also has enough excess buoyancy to support any predetermined load which it will be required to carry and to effect the necessary horizontal restoring forces to offset forces created by any current. As seen in FIG. 9, a rig 76 of the semisubmersible type has been floated into position and lowered until its entire weight, or a selected portion, is borne by the platform. FIG. 10 shows a typical jack-up type rig 78 in which the entire weight is applied to the platform. In FIG. 11, a standard rig 80 is mounted on the platform, which therefore carries its entire weight. In FIG. 12, semi-submersbile servicing rig 84 is shown above the platform.

The conductor housing 18 is normally of such height that it extends above the surface and serves as a continuation of the well conductor. However, in some cases it is suitable to use a short conductor housing 82, as shown in FIGS. 11 and 12, for various special purposes, and such housing terminates below the water level. This application would encounter less horizontal force caused by weather, waves and current.

It will be apparent that the invention disclosed herein provides a relatively simple offshore apparatus which is durable and eliminates the problems encountered with long compressive legs or shafts on gravity or template type structures. The method of installation is unique and effective for producing a viable structure, requiring a minimum of equipment and complication.

What is claimed is:

1. Apparatus for conducting offshore operations in deep water comprising:

a template base lying on the ocean floor in a substantially horizontal position and provided with a plurality of laterally spaced vertically extending passages therethrough;

a plurality of elongate rigid anchorage legs extending vertically through at least some of said passages and anchored in the ocean bed below the base;

at least one buoyant stabilizer member provided with a plurality of vertically extending passages therethrough arranged in registry with the passages in the base and mounted on the legs at a location intermediate their vertical length, with the legs passing through the corresponding passages in the stabilizer member;

and a buoyant load platform located below the surface of the water and provided with a plurality of vertically extending passages therethrough also arranged in registry with the passages in the base and mounted on the legs at their upper portions, with the legs passing through the corresponding passages in the platform;

the stabilizer member being fixedly connected to the legs to minimize lateral swaying movement of the column assembly;

the buoyancy of the stabilizer member and the platform maintaining the legs in tension;

and the platform having sufficient excess buoyancy to enable it to support the maximum predetermined load which it is required to carry.

2. Apparatus as claimed in claim 1; in which at least one elongate rigid well conductor extends vertically through a set of vertically registered passages and is anchored in the ocean bed below the base.

3. Apparatus as claimed in claim 1; in which the upper end of the well conductor extends into the platform and is fixedly secured thereto.

4. Apparatus as claimed in claim 3; in which a conductor housing substantially aligned with the passage for the well conductor is connected to the upper side of the platform and extends to a location above the surface of the water.

5. Apparatus as claimed in claim 1; in which the legs are hollow shafts and are substantially filled with a fluid with a specific gravity less than about 1 to produce the maximum buoyancy effect.

6. The apparatus of claim 5; in which the fluid is air.

7. Apparatus as claimed in claim 1; in which the template base is hollow, and means are provided to fill it wih air for flotation to the site of operations and to fill it with water ballast to cause it to sink to the ocean floor.

8. Apparatus as claimed in claim 1; in which the stabilizer member and platform are hollow, and means are provided to fill them with air for flotation to the site of operations and to insert water ballast to adjust their buoyancy to any desired degree.

9. Apparatus as claimed in claim 1; in which mooring elements are attached to the stabilizer member, extend outward and downward, and are anchored to the ocean bed to substantially eliminate lateral movement of the stabilizer member.

10. Apparatus as claimed in claim 1; in which the base, stabilizer member, and platform are hollow, and means are provided to insert a fluid in them to any desired extent to modify their buoyancy.

11. Apparatus as claimed in claim 10; in which mooring elements are attached to the stabilizer member, extend outward and downward, and are anchored to the ocean bed.

12. Apparatus as claimed in claim 11; in which at least one elongate rigid well conductor extends vertically through a set of vertically registered passages and is anchored in the ocean bed below the base;

its upper end extends into the platform and is fixedly secured thereto;

and a conductor housing substantially aligned with the passage for the well conductor is connected to the upper side of the platform and extends to a location above the surface of the water.

13. Apparatus as claimed in claim 12; in which the conductor is connected to the upper side of the platform and extends to a location below the surface of the water.

14. Apparatus as claimed in claim 1; in which releasable locking means are provided to secure the base, stabilizer member, and platform in stacked relation with the passages in registry to enable floating them as a unit to the site of operations.

15. Apparatus as claimed in claim 1; in which the platform has sufficient buoyancy to restore itself to a position directly over the base when current and/or wave forces deflect the platform's normal position.

16. Apparatus for conducting offshore operations in deep water comprising:

a template base lying on the ocean floor in a substantially horizontal position and provided with a plurality of laterally spaced vertically extending passages therethrough;

a plurality of elongate rigid anchorage legs extending vertically through at least some of said passages and anchored in the ocean bed below the base;

and a buoyant load platform provided with a plurality of vertically extending passages therethrough arranged in registry with the passages in the base and mounted on the legs at their upper portions, with the legs passing through the corresponding passages in the platform;

the platform in mounted position being located well below the surface of the water to minimize disturbance by wave motion;

the buoyancy of the platform maintaining at least the major portion of the length of the legs in tension;

and the platform having sufficient excess buoyancy to enable it to support the maximum predetermined load which it is required to carry.

17. Apparatus as claimed in claim 16; in which the legs are hollow shafts and are substantially filled with air to produce the maximum buoyancy effect.

18. Apparatus as claimed in claim 16; in which the template base is hollow, and means are provided to fill it with air for flotation to the site of operations and to fill it with water ballast to cause it to sink to the ocean floor.

19. Apparatus as claimed in claim 18; in which the platform is hollow, and means are provided to fill it with air for flotation to the site of operations and to insert water ballast to adjust its buoyancy to any desired degree.

20. Apparatus as claimed in claim 16; in which at least one elongate rigid well conductor extends vertically through a set of vertically registered passages and is anchored in the ocean bed below the base;

its upper end extends into the platform and is fixedly secured thereto;

and a conductor housing substantially aligned with the passage for the well conductor is connected to the upper side of the platform and extends to a location above the surface of the water.

21. Apparatus as claimed in claim 16; in which releasable locking means are provided to secure the base and platform in stacked relation with the passages in registry to enable floating them as a unit to the site of operations.

22. A method of installing apparatus for conducting offshore operations in deep water comprising:

providing a plurality of components of substantial lateral expanse, each with a plurality of laterally spaced vertically extending passages therethrough arranged in the same pattern in each component;

rendering each component substantially buoyant;

floatably transporting the components to the site of operations;

reducing the buoyancy of the components sufficiently to cause them to sink, and controlling their descent to cause them to lie on the ocean floor in stacked relation with their vertically extending passages in vertical registry;

providing a plurality of elongate rigid anchorage legs, lowering them in vertical attitude, and inserting them through at least some of the sets of registered passages in the components;

sinking the lower ends of the legs into the ocean floor below the components and anchoring them in the ocean floor to extend vertically upward toward the surface of the water;

increasing the buoyancy of the upper component to cause it to rise toward the surface with the legs slidably engaging corresponding passages in the component;

terminating the ascent of the upper component at the upper portions of the legs and fixedly securing it to the legs;

and utilizing the buoyancy of the upper component to maintain the major portion of the length of the legs in tension.

23. A method as claimed in claim 22; in which the lower component is utilized to maintain the integrity of the anchorage of the legs in the ocean bed.

24. A method as claimed in claim 22; further including providing at least one elongate rigid well conductor, lowering it in vertical attitude, and inserting it through a set of registered passages in the components prior to raising the upper component toward the surface.

25. A method as claimed in claim 3; further including fixedly securing the upper component to the upper portion of the well conductor.

26. A method as claimed in claim 22; further including lowering a drilling apparatus through each of the sets of passages to be occupied by the legs;

drilling holes of predetermined size in the ocean bed below the lower component; and subsequently cementing the legs in position.

27. A method as claimed in claim 22; in which the components include a lower base, an upper load platform, and at least one intermediate stabilizer member;

the buoyancy of the stabilizer member is increased to cause it to rise toward the surface with the legs slidably engaging corresponding passages in the stabilizer member;

a ascent of the stabilizer member is terminated at a location intermediate the vertical length of the legs;

and it is fixedly secured to the legs at that location.

28. A method as claimed in claim 27; further including securing the first ends of a plurality of mooring elements to the stabilizer member;

extending them downwardly and outwardly therefrom; and anchoring their second ends in the ocean bed.

29. A method as claimed in claim 22; in which the components are arranged in stacked relation with their vertically extending passages in vertical registry and are secured together;

and at least the upper component comprising a hollow compartment and is filled with air to render it buoyant;

the components are towed as a unit in floating condition to the site of operations;

and the upper component is ballasted by replacing the air with water to cause the stack to sink to the ocean floor.

30. A method as claimed in claim 29; further including locking the stacked components against vertical separation and lateral displacement during towing and lowering the stack, and unlocking them at the ocean floor for separation and movement to their final positions.

31. A method as claimed in claim 29; in which the lower component is also in the form of a hollow compartment and is filled with air to render it buoyant for towing in floating condition;

and the air is replaced by water ballast at the site of operations to render it non-buoyant.

32. A method as claimed in claim 29; in which the stack includes an intermediate component also in the form of a hollow compartment and it is filled with air to render it buoyant for towing in floating condition;

and the air is replaced by water at the site of operations to render it non-buoyant.

33. A method of installing apparatus for conducting offshore operations in deep water comprising:

providing a plurality of components of substantial lateral expanse, each with a plurality of laterally spaced vertically extending passages therethrough arranged in the same pattern in each component;

transporting the components to the site of operations;

lowering the components and controlling their descent to cause them to lie on the ocean floor in stacked relation with their vertically extending passages in vertical registry;

providing a plurality of elongate rigid anchorage legs, lowering them in vertical attitude, and inserting them through some of the sets of registered passages in the components;

sinking the lower ends of the legs into the ocean bed below the components and anchoring them in the ocean floor to extend vertically toward the surface of the water;

rendering the upper component buoyant to cause it to rise toward the surface with the legs slidably engaging corresponding passages in the component;

terminating the ascent of the upper component at the upper portions of the legs and fixedly securing it to the legs;

and utilizing the buoyancy of the upper component to maintain the legs in tension.

34. A method as claimed in claim 33; further including providing at least one elongate rigid well conductor, lowering it in vertical attitude through a set of registered passages in the components and into the ocean bed, and anchoring it in position.

35. A method as claimed in claim 34; further including fixedly securing the upper component to the upper portion of the well conductor.

36. A method as claimed in claim 33; in which the components include a lower base, an upper load platform, and at least one intermediate stabilizer member;

the stabilizer toward the surface, with the legs slidably engaging corresponding passages in the stabilizer member, to a location intermediate the vertical length of the legs; and the stabilizer is fixedly secured to the legs at that location.

37. A method as claimed in claim 36; further including securing the first ends of a plurality of mooring elements to the stabilizer member;

extending them downwardly and outwardly therefrom;

and anchoring their second ends in the ocean bed.

38. A method as claimed in claim 36; further including rendering the stabilizer member buoyant to cooperate with the load platform in maintaining the legs in tension.

* * * * *

UNITED STATES PATENT OFFICE
CERTIFICATE OF CORRECTION

Patent No. 4,083,193 Dated April 11, 1978

Inventor(s) James E. Evans

It is certified that error appears in the above-identified patent and that said Letters Patent are hereby corrected as shown below:

Column 7, line 23 Delete "Claim 1" and insert --Claim 2"

Column 9, line 61 Delete "a ascent" and insert --the ascent--

Column 1, line 33 Delete "servere" and insert --severe--

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*